US008038171B2

(12) United States Patent
Bailey

(10) Patent No.: US 8,038,171 B2
(45) Date of Patent: Oct. 18, 2011

(54) DEVICE FOR CONNECTING SKI TIPS

(76) Inventor: Donald H. Bailey, Afton, VA (US)

( * ) Notice: Subject to any disclaimer, the term of this patent is extended or adjusted under 35 U.S.C. 154(b) by 0 days.

(21) Appl. No.: 11/973,763

(22) Filed: Oct. 10, 2007

(65) Prior Publication Data

US 2009/0039635 A1 Feb. 12, 2009

Related U.S. Application Data

(60) Provisional application No. 60/850,523, filed on Oct. 10, 2006.

(51) Int. Cl.
*A63C 11/00* (2006.01)

(52) U.S. Cl. ..... 280/818; 280/817

(58) Field of Classification Search ..... 280/814, 280/816, 817, 818; 434/253
See application file for complete search history.

(56) References Cited

U.S. PATENT DOCUMENTS 3,066,328 A 6/1959 Jones
3,357,714 A 12/1967 Kuehn
3,439,387 A 4/1969 Churches
3,703,299 A 11/1972 Kutchma
3,862,764 A 1/1975 Hartz
3,907,320 A 9/1975 Charneck
3,992,022 A 11/1976 Albers
4,643,444 A * 2/1987 Parkinson ..... 280/606
4,828,288 A 5/1989 Humbert
4,936,603 A 6/1990 Reynaud
5,531,480 A 7/1996 Foertsch
6,671,933 B1 * 1/2004 Friend et al. ..... 24/265 H
7,052,044 B1 5/2006 Streeter

* cited by examiner

*Primary Examiner* — John Walters

(57) ABSTRACT

Disclosed is a device to connect the tips of skis and thereby enable a skier to create, hold, and adjust the shape of a wedge with his skis. The device is comprised of two sleeves which slip over and are secured to the upturned tips of the skis. The sleeves are connected by a length of flexible, stretchable, or both, material. This connection is either fixed or made by a novel easily detachable hook. The device allows the skis to be easily connected or disconnected for lift rides, when walking across flat terrain, or to evaluate the progress of the skier during a lesson. As a result, disclosed is a novel device which enables a skier to make, hold, and adjust a wedge while being easily detached for normal skiing and easily used by a skier or instructor wearing gloves or mittens.

6 Claims, 4 Drawing Sheets

DEVICE FOR CONNECTING SKI TIPS

RELATED U.S. PATENT APPLICATION DATA

Applicant claims priority for this application to U.S. Provisional Application No. 60/850523 filed on Oct. 10, 2006.

FIELD OF THE INVENTION

The invention described generally relates to an improved device to connect the tips of skis and thereby enable a skier to create, hold, and adjust the shape of a wedge with his skis.

DESCRIPTION OF THE RELATED ART

A basic snow skiing technique for beginning skiers is known as the wedge or snowplow. The wedge is created by tilting the skis onto their inner edges. This edging along with the wedge shape and strength of the skier combine to allow the skier to control their speed down the hill and aid in the turning of their skis. Beginning snow skiers, especially children, often have difficulty creating a wedge shape with their skis. Not only do they have difficulty creating the shape; they also have a hard time holding the shape once they start moving down the slope. Children most often encounter this problem because their motor functions are not fully developed.

The device disclosed herein, known as the KidKlip™, is designed to aid skiers in attaining and then maintaining their skis in the shape of the wedge. The KidKlip allows children and adults to create the perfect wedge. All that is needed is for the skier to posses enough strength to widen his stance. The KidKlip does the rest by holding the tips close to one another. The width of the skier's stance will determine the angle of the wedge and therefore the speed at which the skier descends the ski slope. The KidKlip not only helps the skier in making and holding a wedge; it also helps keep the tips of skis from crossing while skiing.

Several ski teaching aids have been patented that will aid in creating the wedge. Among them are; Kuehn (U.S. Design Pat. No. 3,357,714), Kutchma's (U.S. Design Pat. No. 3,703,299), Charneck's (U.S. Design Pat. No. 3,907,320), Albers's (U.S. Design Pat. No. 3,992,022), Humbert's (U.S. Design Pat. No. 4,828,288), Reynaud's (U.S. Design Pat. No. 4,936,603), Foertsch's (U.S. Design Pat. No. 5,531,480) and Streeter's (U.S. Design Pat. No. 7,052,044). There are also a few that do not appear to be patented that are marketed under the names: The Edgie Wedgie, The Tip Lock Ski Accessory, and the KlipSki.

While all of the designs accomplish some degree of success none work well as they are too complicated, require modification of the ski, too bulky to be of practical use to a ski instructor, too cumbersome to use by a skier wearing mittens or gloves, or for a variety of other reasons just don't work very well.

For a device to be effective to form the perfect wedge, it must be compact, easy to secure to the skis, easy to use in cold weather by a skier or instructor wearing mittens or gloves. Moreover, it must allow the skis to be easily connected or disconnected from each other, require no modification of the ski, and be inexpensive.

The KidKlip is the first ski accessory which fulfills these needs.

SUMMARY OF THE INVENTION

The KidKlip attaches to the upturned tips of a pair of skis. It allows the skier to create, hold and adjust the shape of the wedge. The KidKlip accomplishes this by slipping two nearly identical or identical sleeves over the upturned tips of the skis. These two sleeves are then secured to the tips. In the embodiments disclosed, the sleeves are secured by the use of thumbscrews. A length of flexible, stretchable, or both, material such as latex tubing is attached at one or both ends to a pin which is an integral part of one of the sleeves, or to a pin which is an integral part of a novel detachable hook. The hook then attaches to a loop which is integral to a sleeve and is modified to receive the shape of the tips of the hook. Two sleeves are thereby secured by the latex tubing which keeps the ski tips together. The novel hook in conjunction with the modified loop, an integral part of a sleeve, allows the skis to be easily connected or disconnected for lift rides, when walking across flat terrain, or to evaluate the progress of the skier during a lesson. As a result, the KidKlip provides a novel device which enables a skier to make, hold, and adjust a wedge while being easily detached for normal skiing and easily used by a skier or instructor wearing gloves or mittens.

These and other advantages are shown in the claims below and form a part hereof. For a better understanding of this invention and its advantages, reference should be made to the figures which form a further part hereof and to the accompanying descriptive matter in which there is described one or more preferred embodiments of the invention.

Figure 1:
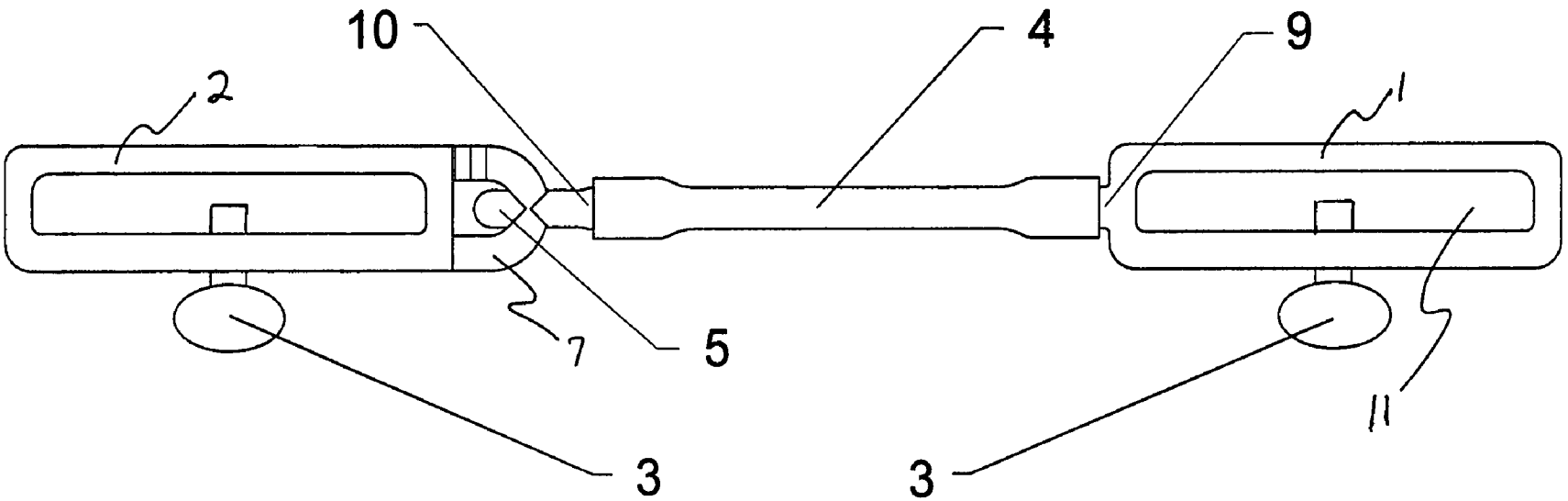
FIG. 1 shows a front view of the entire KidKlip.

The following Reference Numbers are to be used with Figures.

1. Sleeve with a unitary pin
2. Sleeve with a unitary loop
3. Thumbscrews (threads not shown)
4. Length of latex tubing
5. Hook
6. "V" grooves in loop integral to a sleeve
7. Loop integral to a sleeve
8. "V" tips of the hook
9. Pin integral to a sleeve
10. Pin integral to a hook

DETAILED DESCRIPTION OF THE INVENTION

The advantages of the KidKlip will be seen in with the following description in connection with the accompanying drawings.

Referring now to FIG. 1, the KidKlip is comprised two sleeves being, either or both, a sleeve 1 with a unitary pin 9 or a sleeve 2 with a unitary loop 7, two thumbscrews 3, a length of latex tubing 4 having first and second ends, and a hook 5 with a unitary pin 10. In one embodiment, the first end of the latex tubing 4 is attached to unitary pin 9 on sleeve 1 and the second end of latex tubing 4 is attached to unitary pin 10 on hook 5. Hook 5 is designed to engage with loop 7 integral to sleeve 2. The KidKlip is used by slipping the sleeves 1 and 2 over the upturned portion of the skier's skis (not shown). The ski tips are inserted into the interstitial spaces 11 of the sleeves 1 and 2. The sleeves 1 and 2 are each then secured to a ski by tightening the thumbscrew 3 against the ski.

Figure 2:
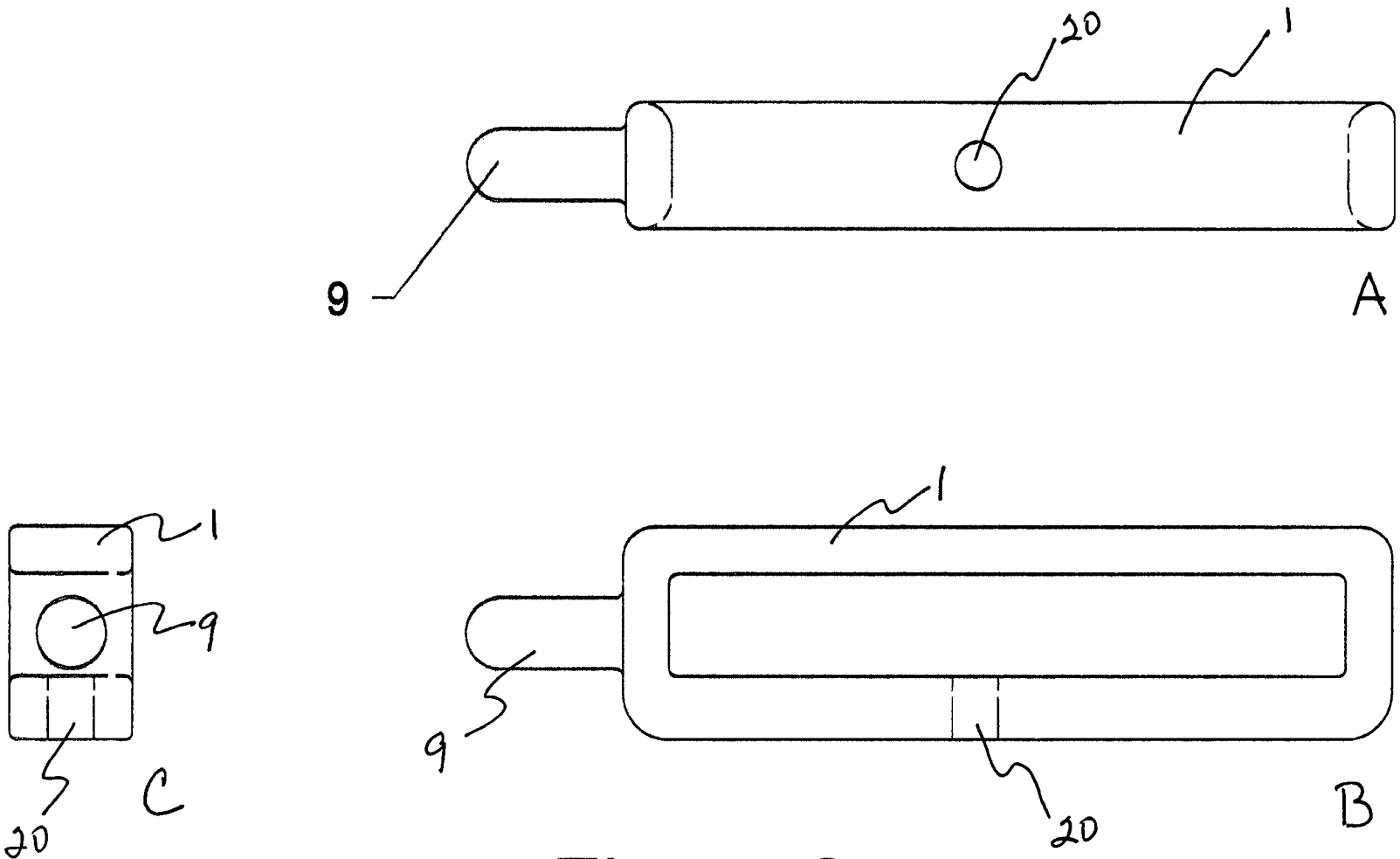
FIG. 2A shows the top view of a sleeve with a unitary pin.
FIG. 2B shows the front view of a sleeve with a unitary pin.
FIG. 2C shows the pin end view of a sleeve with a unitary pin.

Turning to FIG. 2A, the top of sleeve 1 with a unitary pin 9 is shown. Threaded hole 20 is threaded to receive thumbscrew 3 (FIG. 1). Threaded hole 20 is threaded to receive thumbscrew 3 (FIG. 1). FIG. 2B depicts the front view of sleeve 1 with a unitary pin 9 and showing threaded hole 20. And, FIG. 2C reflects the pin end view of sleeve 1 with a unitary pin 9 and showing threaded hole 20.

Figure 3:
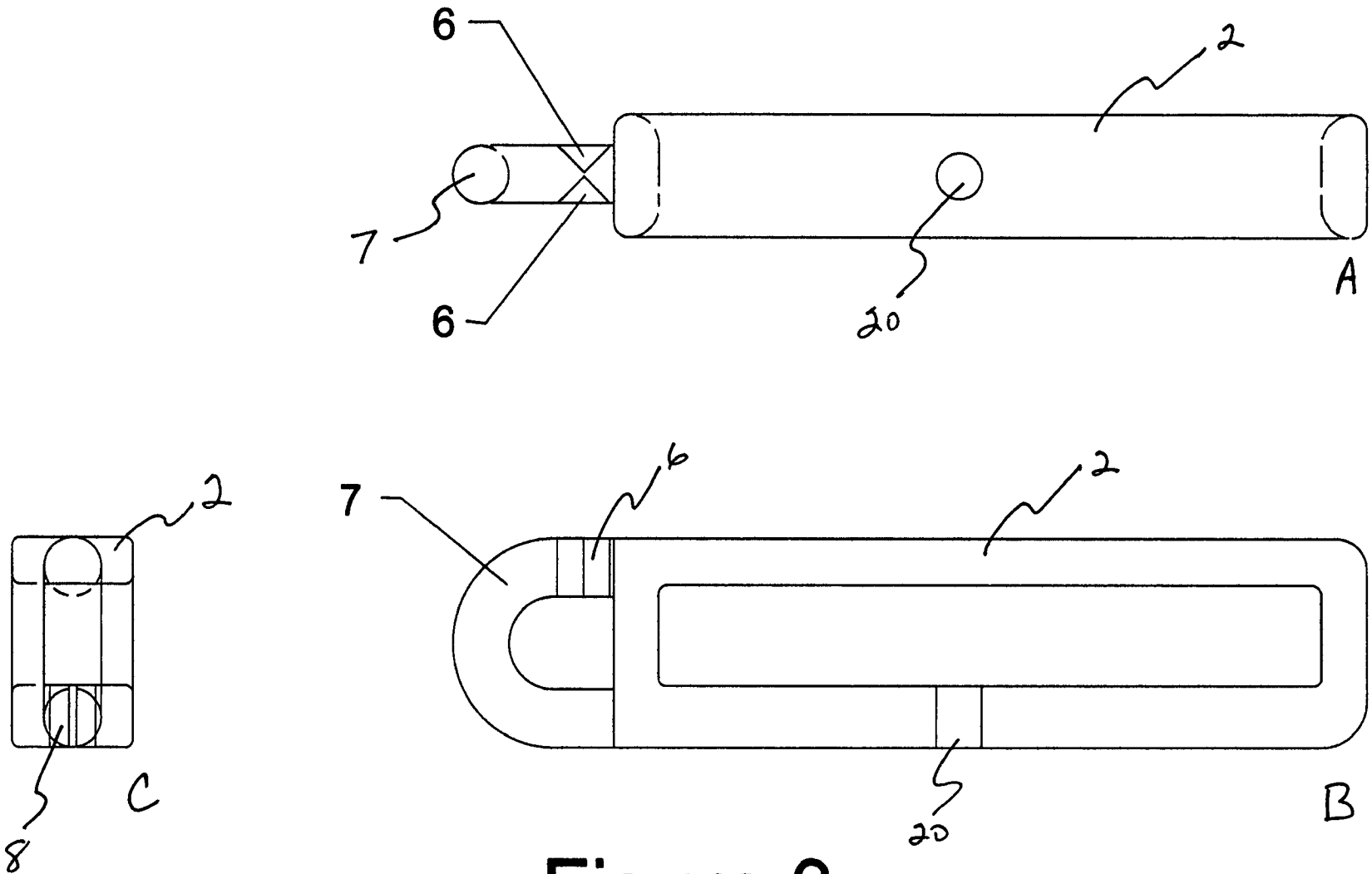
FIG. 3A shows the top view of a sleeve with a unitary loop.
FIG. 3B shows front view of a sleeve with a unitary loop.
FIG. 3C shows loop end view of a sleeve with a unitary loop.
Figure 4:
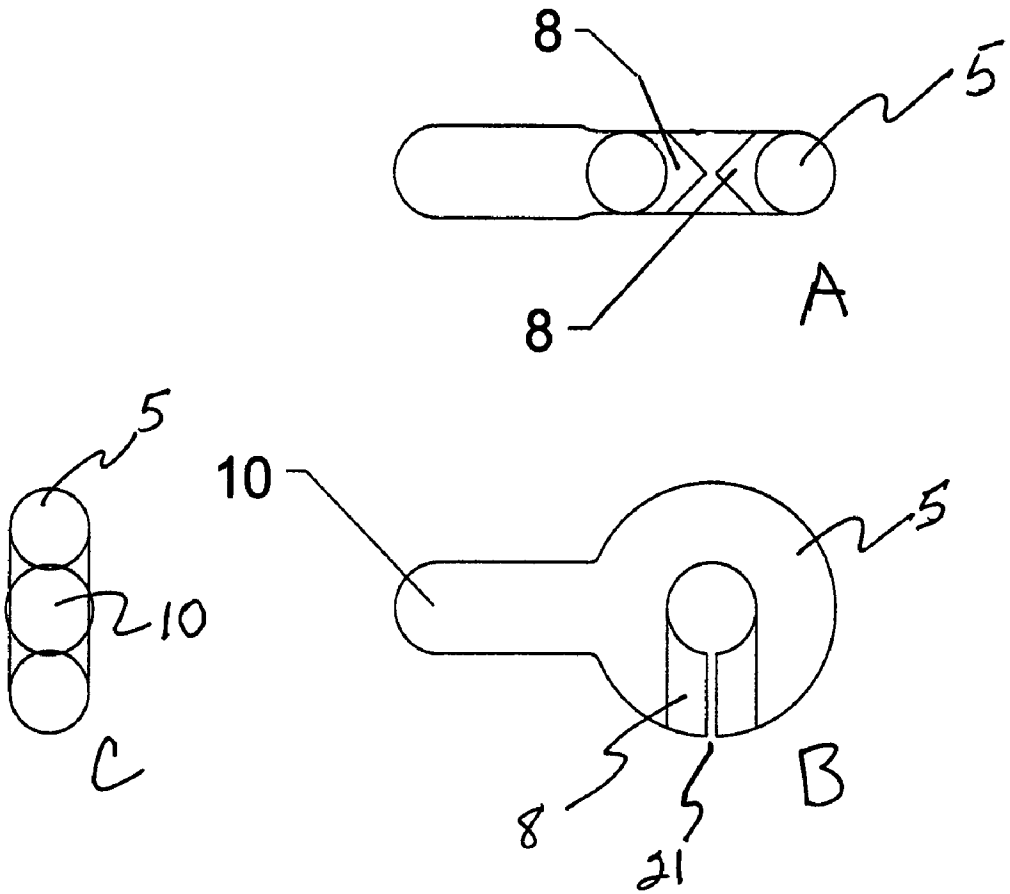
FIG. 4A shows a view of the tips of the hook.
FIG. 4B shows front view of the hook.
FIG. 4C shows the pin end view of the hook.

FIG. 3A shows the top of sleeve 2 with unitary loop 7 in the body of which is threaded hole 20. Loop 7 is modified by "V" grooves 6 to receive the modified "V" tips 8 of hook 5 (FIG. 4). FIG. 3B shows the front view of sleeve 2 with integral loop 7 and "V" grooves 6. Likewise, FIG. 3C is the loop 7 end view of sleeve 2 showing a cross section of "V" grooves 6. It should be noted that the grooves of loop 7 may be one or more and of any configuration so as to receive the tips of hook 5.

FIG. 4A shows a bottom view of hook 5 with unitary pin 10 with "V" tips 8. FIG. 4B is a front view of hook 5 with integral pin 10, and "V" tips 8. Note that "V" tips 8 of hook 5 have a space 21 between them allowing hook 5 to engage the "V" grooves of loop 7 of sleeve 2 thereby allowing only one way for hook 5 to engage and disengage with loop 7. This novel hooking mechanism allows the KidKlip to be used by children and gloved skiers or instructors. FIG. 4C is an end view of pin 10 integral to hook 5. In use, hook 5 slips over the "V" grooves 6 molded into the loop 7 of sleeve 2. Under normal use the hook 5 will not release from hook 7. This is due the unique shape of its opening in conjunction with the "V" groove 6 molded into loop 7 on sleeve and the ability of the latex tubing 4 to keep the hook 5 from twisting. The tips 8 of hook 5 may be one or more and of any configuration so as to slidingly engage with groove or grooves of loop 7.

In another embodiment and referring to FIG. 1, each of the two sleeves of the KidKlip are sleeve 2 with integral loops 6. The first end of latex tube 4 is attached to a hook 5 and the second end of latex tube 4 is attached to a second hook 5. Each of hooks 5 are inter-slidingly engaged with loop 7 of one of the two sleeves 2. Thus, the user may easily disengage either ski from hook 5 or both skis from both hooks 5, allowing free skiing while sleeves 2 remain on the skis and latex tube 4 connected to the two hooks 5 to be pocketed.

It must be noted that "V" grooves 6 and "V" tips 8 may be designed or sculpted in any shape to allow them to engage with one another. Moreover, "V" grooves 6 may be positioned anywhere on loop 7 and likewise, "V" tips 8 may be positioned anywhere on hook 5. Preferred embodiments of these grooves and tips are "V" in shape as shown in the figures as well as semi-circular (not shown). Any other inter-sliding shapes may also be used. These grooves and tips may be one or more.

The shape of hook 5 is shown as a "C" but may be any shape as may be loop 7.

This novel hook and loop inter-sliding design of the KidKlip allows each hook 5 to be removed easily from a loop 7 in only one direction and effectively prevents hook 5 from accidentally releasing from loop 7 during use.

Even though the specific details of the structure and function of the disclosed invention is presented, it is for illustration only, recognizing that slight changes may be made in the shape, size and arrangement of the parts within the disclosed invention, thus the principles of the invention to the full extent described by the broad, general meaning of the terms used in the following claims are sought to be covered by these letters patent.

While a specific embodiments of the invention have been shown and described in detail, it will be understood that the invention may be modified without departing from the spirit of the inventive principles set forth in the following claims.

I claim:

1. A device for connecting ski tips to aid in making, holding, or adjusting a skier's skis' wedge comprising:

at least one sleeve which may be attached to a ski, the sleeve comprising an integral loop, the loop comprising one or more grooves;

at least one hook comprising two tips forming a space there between, permitting the tips to slidingly engage the grooves of the loop such that the hook can be removably connected to the loop.

2. The device according to claim 1 wherein the sleeve surrounds the upturned tip of the ski.

3. The device according to claim 1 wherein the sleeve is attached to the ski by a thumbscrew threadedly connected to the sleeve.

4. The device of claim 1 further comprising a length of flexible or stretchable material attached to the at least one hook.

5. The device according to claim 4 wherein the flexible or stretchable material is latex.

6. A method for connecting ski tips to aid in making, holding, or adjusting a skier's ski's wedge comprising steps of:

attaching a sleeve with an integral loop to one or both skis, the loop comprising one or more grooves;

removably connecting the loop of one sleeve to another sleeve with at least one hook, the hook comprising two tips forming a space there between to slidingly engage the one or more grooves of the loop.

* * * * *